US007604526B2

(12) United States Patent
Liu

(10) Patent No.: US 7,604,526 B2
(45) Date of Patent: Oct. 20, 2009

(54) BRASSIERE WITH UNDER BREAST SUPPORT

(75) Inventor: Zhen Qiang Liu, Kwai Chung (HK)

(73) Assignee: Regina Miracle International Enterprises Ltd., Hong Kong (HK)

( * ) Notice: Subject to any disclaimer, the term of this patent is extended or adjusted under 35 U.S.C. 154(b) by 348 days.

(21) Appl. No.: 11/471,841

(22) Filed: Jun. 21, 2006

(65) Prior Publication Data

US 2007/0298681 A1 Dec. 27, 2007

(51) Int. Cl.
*A41D 3/00* (2006.01)

(52) U.S. Cl. ..... 450/39; 450/92; 450/93; 450/41

(58) Field of Classification Search ..... 450/39, 450/92, 93, 54–58, 1
See application file for complete search history.

(56) References Cited

U.S. PATENT DOCUMENTS

| | | | | |
|---|---|---|---|---|
| 6,000,994 | A * | 12/1999 | Salotto | 450/92 |
| 6,425,800 | B1 * | 7/2002 | Huang | 450/41 |
| 6,811,464 | B2 | 11/2004 | Li | 450/57 |
| 6,837,771 | B2 * | 1/2005 | Falla | 450/39 |
| 6,966,815 | B2 * | 11/2005 | Weinerth | 450/41 |
| 7,179,150 | B2 * | 2/2007 | Luk et al. | 450/39 |
| 2002/0106970 | A1 | 8/2002 | Falla | 450/1 |
| 2003/0232571 | A1 | 12/2003 | Weinerth | 450/41 |
| 2004/0224604 | A1 | 11/2004 | Luk | 450/39 |
| 2007/0004315 | A1 | 1/2007 | Luk et al. | 450/39 |

FOREIGN PATENT DOCUMENTS

| | | |
|---|---|---|
| DE | 201 02 833 | 7/2001 |
| GB | 2 371 206 | 7/2002 |
| JP | 2004-263315 | 9/2004 |
| WO | WO 2005/048750 | 6/2005 |

OTHER PUBLICATIONS

New U.S. Patent Application filed today Jun. 21, 2006 Serial No. not yet assigned, Assignee: Regina Miracle International Enterprises Limited, The Title is A Reinforced Seamless Brassiere, the inventor is Zhen Qiang Liu.
United Kingdom Search Report. 2 pages.

* cited by examiner

*Primary Examiner*—Gloria Hale
(74) *Attorney, Agent, or Firm*—Ostrolenk Faber LLP

(57) ABSTRACT

A brassiere cup assembly defining two breast cups, a bridge between the two breast cups, and for each of the two breast cups a flange extending from at least part of a lower peripheral edge of the breast cup. The brassiere cup assembly comprises at least two plies of material which are laminated to each other and molded to define the shape of the two breast cups, and a non-metallic resiliently bendable under breast support strip laminated with and interposed between two of the at least two plies of material at or adjacent the lower peripheral edge of one or both of the two breast cups.

29 Claims, 10 Drawing Sheets

BRASSIERE WITH UNDER BREAST SUPPORT

FIELD OF THE INVENTION

The present invention relates to brassieres incorporating under breast support, in particular although not solely to brassieres that incorporate such support as a substitute to the conventional steel underwire support.

BACKGROUND

Brassieres (hereinafter "bras") that incorporate underwire structures are common. The underwire structures are located beneath the breasts of the wearer and offer support to the shape of the bra and the breasts. It is well known that underwire bras can be prone to damage. Such damage can incur inherently as a result of the fact that the underwire is a rigid item of a small diameter steel rod that is incorporated in a soft fabric bra. Underwires have a habit of affecting the integrity of the bra in particular when the bras are being washed and tumble dried. The underwire can puncture through a channel in which it may be encased and incorporated with the bra. In particular the ends of the underwire can become exposed, sometimes resulting in becoming removed from the bra and being lost. Protruding underwires may cause discomfort to the wearer of the bra by pressing against the skin of the wearer. The wire used for underwire bras is however a cheap solution for providing support. A wire, typically made of steel, is a low cost of manufacture item that has the desired inherent properties useful for providing support. To reduce its propensity to puncture layers of the bra the underwire is normally located in a channel. This adds to the cost of manufacture.

Accordingly it is an object of the present invention to provide a bra incorporating under breast support as an alternative to an underwire support that will address the above-mentioned disadvantages or that will at least provide the public with a useful choice.

BRIEF DESCRIPTION OF THE INVENTION

Accordingly in a first aspect the present invention consists in a brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) a non-metallic resiliently bendable under breast support strip laminated with and interposed between two of the at least two plies of material at or adjacent the lower peripheral edge of one or both of the two breast cups.

Preferably the under breast support strip is located on the breast cup side adjacent the lower peripheral edge.

Preferably two of the under breast support strip are provided, each of which being located on the breast cup side adjacent the lower peripheral edge of one of the two breast cups.

Preferably a further two of the under breast support strip are provided, each of which being located on the flange side adjacent the lower peripheral edge of one of the two breast cups.

Preferably a further under breast support strip is provided, the further under breast support strip being a unitary under breast support strip that extends adjacent the lower peripheral edge of both breast cups on the flange side and across the bridge.

Preferably the under breast support strip is located on the flange side adjacent the lower peripheral edge.

Preferably two of the under breast support strip are provided, each of which being located on the flange side adjacent the lower peripheral edge of one of the two breast cups.

Preferably the under breast support strip is a unitary under breast support strip that extends adjacent the lower peripheral edge of both breast cups and across the bridge.

Preferably at least two of the at least two plies of material are co-extensive with each other.

Preferably only two plies of material are provided, each being a fabric ply.

Preferably two of the plies of material are fabric plies and an intermediate ply is interposed between the two fabric plies, and wherein the under breast support strip is laminated to and between one of the two fabric plies and the intermediate ply.

Preferably the intermediate ply comprises at least one layer of foam.

Preferably the intermediate ply is coextensive with the two fabric plies.

Preferably at least at the breast cups, a core assembly of at least two laminated plies of foam material is provided, and wherein the under breast support strip is laminated to and between the two laminated plies of foam material.

Preferably the under breast support strip is of a width greater than its thickness.

Preferably the under breast support strip includes a non-woven material.

Preferably the under breast support strip includes a non-woven fabric.

Preferably the under breast support strip includes a substantially non-stretchable material.

Preferably the under breast support strip includes a foam material.

Preferably the under breast support strip includes a foam material that is harder than the foam of the intermediate ply.

Preferably the under breast support strip includes a foam material that is harder than the foam of the core assembly.

Preferably the brassiere cup assembly is made by a hot molding process, during which process the under breast support strip is incorporated into the brassiere cup assembly.

In a further aspect the present invention consists in a brassiere that includes a brassiere cup assembly as hereinbefore described.

Preferably that is a seamless brassiere.

Preferably that is a seamless and molded brassiere.

In a further aspect the present invention consists in a brassiere cup comprising:

at least two laminated plies of material molded to define the shape of the brassiere cup; and a non-metallic resiliently bendable under breast support strip interposed between the plies of material at or adjacent a lower peripheral edge of the brassiere cup.

Preferably at least two of the at least two plies of material are co-extensive with each other.

Preferably only two plies of material are provided, each being a fabric ply.

Preferably two of the plies of material are fabric plies and an intermediate ply is interposed between the two fabric plies, and wherein the under breast support strip is laminated to and between one of the two fabric plies and the intermediate ply.

Preferably the intermediate ply comprises at least one layer of foam material.

Preferably the intermediate ply is coextensive with the two fabric plies.

Preferably a core assembly of at least two laminated plies of foam material is provided, and wherein the under breast support strip is laminated to and between the two laminated plies of foam material.

Preferably the under breast support strip is of a width greater than its thickness.

Preferably the under breast support strip includes a non-woven material.

Preferably the under breast support strip includes a substantially non-stretchable material.

Preferably the under breast support strip includes a foam material.

Preferably the under breast support strip includes a foam material that is harder than the foam of the intermediate ply.

Preferably the under breast support strip includes a foam material that is harder than the foam of the core assembly.

Preferably the brassiere cup is made by a hot molding process, during which process the under breast support strip is incorporated into the brassiere cup.

In a further aspect the present invention consists in a seamless brassiere including two breast cups, a bridge between the two breast cups, and a chest band extending from each of the two breast cups, the brassiere comprises:

(a) an outer and an inner ply of fabric material laminated to each other and molded to define the shape of the two breast cups;

(b) a first panel of a substantially non-stretchable material interposed between and laminated with the outer and inner plies of fabric material at the bridge;

(c) a second panel of a substantially non-stretchable material laminated with and interposed between the outer and inner plies of fabric material at or adjacent the intersection of one of the two chest bands and the breast cup from which such chest band extends;

(d) a third panel of a substantially non-stretchable material laminated with and interposed between the outer and inner plies of fabric material at or adjacent the intersection of the other of the two chest bands and the breast cup from which such chest band extends; and (e) a non-metallic resiliently bendable under breast support strip laminated to and interposed between the outer and inner plies of fabric material at or adjacent the lower peripheral edge of one or both of the two breast cups.

Preferably the first, second and third panels are a single continuous panel.

Preferably the brassiere further comprises a reinforcement zone defined by a hot melt adhesive interposed between the outer and inner layers of fabric material adjacent the side periphery of at least one of the two breast cups, the side periphery being extending between the chest band extending from the at least one of the two breast cups and the location where a shoulder strap joins or may join the at least one of the two breast cups.

In a further aspect the present invention consists in a seamless brassiere which comprises:

(a) a core assembly of an outer layer of foam material laminated with an inner layer of foam material, the core assembly being molded to define two breast cups and a bridge between the two breast cups;

(b) an outer and an inner exterior layer of a fabric material disposed respectively on the respective outer and inner side of the core assembly, one or both of the outer and inner exterior layers being extending beyond the boundary of the core assembly to form the or part of the chest bands of the brassiere; and (c) a non-metallic resiliently bendable under breast support strip laminated with and interposed between the outer and inner layers of foam material at or adjacent the lower peripheral edge of one or both of the two breast cups.

Preferably the brassiere further comprises a panel of a substantially non-stretchable material laminated with and interposed between the outer and inner layers of foam material at the bridge.

Preferably the core assembly further comprises a flange extending from at least part of the lower peripheral edge of each of the two breast cups.

In a further aspect the present invention consists in a method of forming a brassiere cup including the step of:

hot molding and laminating together at least two overlapping plies of flexible and moldable material and a non-metallic resiliently bendable under breast support strip positioned between the two plies and at a region of the two overlapping plies where or adjacent to where the lower peripheral edge of the brassiere cup will be formed by the hot molding and laminating.

In a further aspect the present invention consists in a method of forming a brassiere cup including the steps of:

interposing a non-metallic resiliently bendable under breast support strip between two overlapping plies of flexible and moldable material at or adjacent to a region of the two overlapping plies where a lower peripheral edge of the brassiere cup is to be defined;

hot molding the two overlapping plies of material and the under breast support strip to form a three-dimensional brassiere cup form that includes the lower peripheral edge, wherein the hot molding simultaneously laminates the two overlapping plies together; and trimming the hot-molded and laminated assembly of the two overlapping plies and the under breast support strip to define the three-dimensional brassiere cup. In a further aspect the present invention consists in a method of forming a brassiere including the steps as hereinbefore described.

BRIEF DESCRIPTION OF THE DRAWINGS

Preferred forms of the present invention will now be described with reference to the accompanying drawings in which.

DETAILED DESCRIPTION OF THE INVENTION

Where reference herein is made to "inner" or "outer" or similar terms, they are understood to be with reference to the body of the wearer of the bra. For example, the "innermost" or "inward" or "inner side" or "inner region" is the side of the bra that is more proximate to the body of the wearer than the outwardly or outer more portions of the bra or its components or subassemblies.

A first preferred embodiment of the invention will now be described with reference to the accompanying drawings.

Figure 1A:
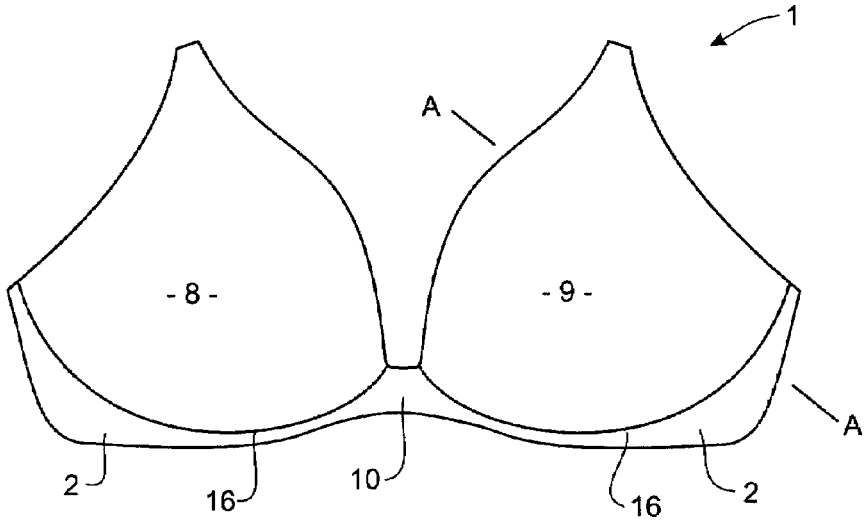
FIG. 1*a* is a front view of components defining the breast cup assembly for a bra of a first preferred embodiment.
Figure 7:
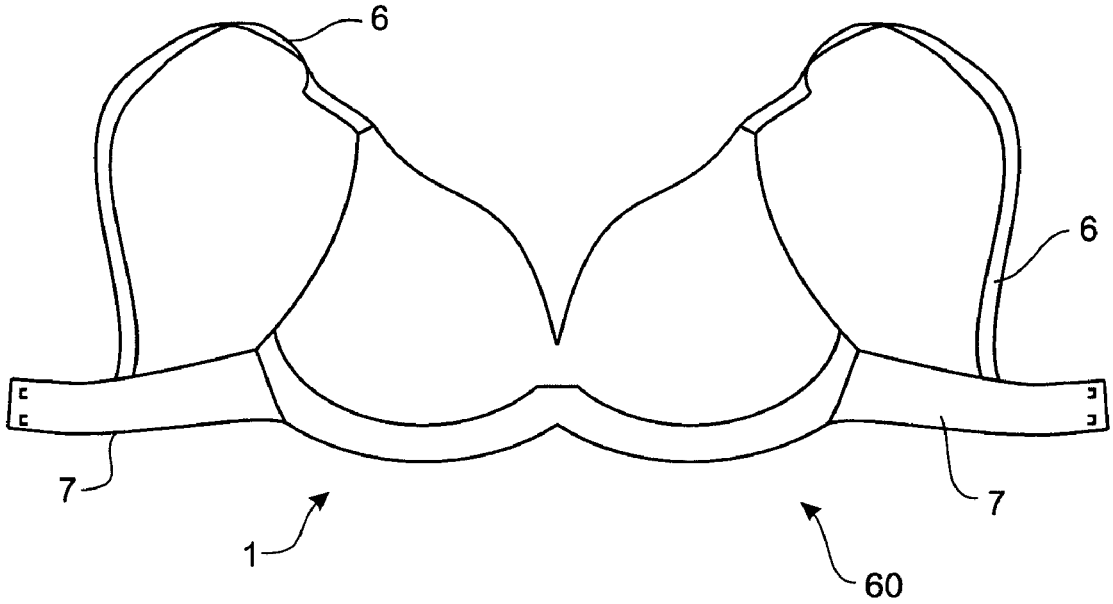
FIG. 7 illustrates a front view of a bra that includes the components of the breast cup assembly as shown with reference to FIGS. 1-6.

FIG. 1*a* is a front view of the breast cup assembly 1 of a bra according to a first preferred embodiment of the invention. It may form part of a bra 60 as shown in FIG. 7. The components of the breast cup assembly 1 as for example shown in FIG. 1*a* may comprise of several plies of material that are connected together, some or all of which are laminated or substantially laminated together. The breast cup assembly 1 may be incorporated with other components to define a bra 60 as for example shown in FIG. 7. The other components may include shoulder straps 6 and chest bands 7.

The chest bands 7 and the shoulder straps 6 may be separate components which are attached to the breast cup assembly 1, or they or any of them may be an extension of the breast cup assembly 1, i.e., the or part of the components defining the breast cup may extend beyond the boundary of the breast cup assembly 1 to define or constitute the chest bands 7 and/or the shoulder straps 6, in which case from the breast cup to the chest band there is no physical or externally visible boundary of the breast cup assembly 1 as such.

The components defining the breast cup assembly 1 of the bra are made by a molding and laminating process (preferably with use of adhesives) to define these components in their appropriate shape. Such components define the two breast cups 8 and 9 which are of three dimensional and breast cup shape. The components of the breast cup assembly 1 are preferably of a seamless assembly of plies of material. The bra according to the first preferred embodiment is preferably a seamless bra. Reference in this specification and the claims to seamless is understood to mean that the bra is visibly substantially seamless. In particular, the edges of the bra are finished in a seamless way. This may for example be achieved by ultrasonic welding, or by folding the edge of an outer layer over and affixing it to an inner layer by a non-stitching means, or by some other means that is substantially without seams. Seams may however be found inside the bra structure where it is not externally visible, or in less conspicuous externally visible locations such as the region where the shoulder strap 6 is attached to the breast cup assembly 1, or the region where a hook or eye tape is connected to the chest bands 7. In addition, seams may also be externally visible on the inner side of the bra.

The components defining the breast cup assembly 1 define breast cups 8 and 9, a bridge 10 between the breast cups 8 and 9 and preferably lower peripheral flange 2 which extends about at least part of the lower peripheral edge 16 of each of the breast cups 8 and 9. The lower peripheral flange 2 and bridge 10 are preferably formed by a ply or plies of a moldable material that are integral across the flange 2 and the bridge 10. This ply or these plies may be joined to plies defining the breast cups 8 and 9 or they may be integral with the plies defining the breast cups 8 and 9. Preferably at least some of the ply or plies of moldable material of the breast cup assembly 1 are continuous across the breast cups 8, 9 and the bridge 10 and, where provided, the flange 2. The breast cup assembly 1 is preferably defined by coextensive plies of moldable material that are laminated or substantially laminated together.

Figure 1B:
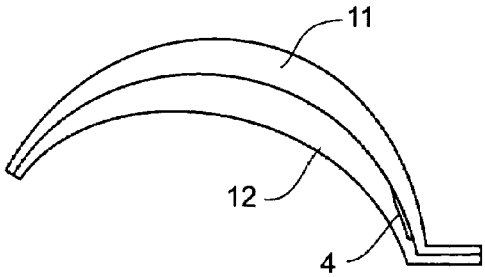
FIG. 1*b* is a sectional view through section AA of FIG. 1*a* of the first preferred embodiment.
Figure 1C:
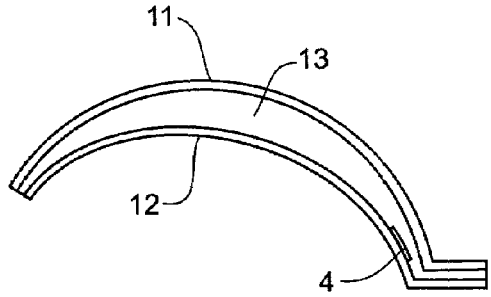
FIG. 1*c* shows a variation to section AA of the first preferred embodiment.
Figure 1D:
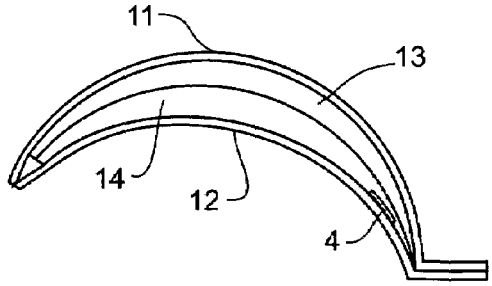
FIG. 1*d* shows a further variation to section AA of the first preferred embodiment.

With reference to FIGS. 1*c* and 1*d*, the coextensive and contiguous plies of moldable material may consist of an exterior ply 11 of, for example, a fabric material and an interior ply 12 of, for example, a fabric material. An additional interposed ply 13 or additional plies of material may be interposed between the exterior and interior plies 11, 12. These are preferably laminated or substantially laminated together across their entire contiguous surfaces, preferably with use of adhesives. The additional interposed plies, where provided, may also be coextensive with the exterior and interior plies 11, 12. The interposed ply 13 (or plies) as for example shown in FIG. 1*c* is (or are) for example coextensive with the plies 11, 12. Alternatively and as for example shown in FIG. 1*d*, the interposed ply 13 and the second interposed ply 14 may not be coextensive with the plies 11, 12. Here, the interposed plies 13 and 14, which preferably are of foam material, may define a bra core assembly as described in our earlier patent application US2004/0224604 which is hereby incorporated by way of reference.

Reference in this specification and the claims to "interposed" or "between" is understood to mean that the thing that is interposed between or that is between some other things may or may not be contiguous with those or any of those other things. In other words, there may be intervening objects although such are not necessarily present.

In the most preferred form the interposed ply 13 and any additional ply or plies such as ply 14 are preferably coextensive with the exterior and interior plies 11, 12 at each of the breast cups 8 and 9 and the flange 2 and the bridge 10. The exterior ply 11 is preferably of a fabric material such as a synthetic woven material which may include polyester, or may be of a material commonly known as spandex. Likewise the interior ply 12 may also be of such materials.

Alternatively one or both of the interior and exterior plies 11, 12 may be of a foam material as for example shown in FIG. 1*b*. Where one or both are of a foam material such as shown in FIG. 1*b* and described in US2004/0224604, a further covering ply or plies of for example a fabric material may subsequently be applied to cover the foam so as to provide a finished bra.

The present invention may also be applicable where the bra does not include a flange 2. Where the flange 2 is present and foam extends to the flange 2 also, the thickness of foam at the flange 2 is preferably less than the thickness of foam at the breast cups. This can be achieved by appropriate compressive molding and laminating of the plies of material at the breast cups and at flange 2. This reduced thickness of foam at the flange 2 reduces the stretchability of the foam at the flange 2. The components defining the breast cups are generally stretchable. Where foam is present at breast cups 8 and 9 and extends from the breast cups to the flange 2, a reduction in thickness of the foam at the flange can help make the flange 2 and the bridge 10 non-stretchable or substantially non-stretchable. Non-stretchability is desired because non-stretchability together with the tensile forces provided by the shoulder straps and the chest bands provide the supporting function to keep the breasts in position.

Reference in this specification and the claims to "non-stretchability" (or a non-stretchable material) is understood to mean substantial rather than absolute or perfect non-stretchability.

Shown in FIGS. 1*c* and 1*d* are the exterior ply 11 and the interior ply 12 preferably laminated with the interposed ply or plies 13. Alternatively the exterior ply 11 may be loosely applied over the interposed ply 13 and only be engaged to the interposed ply 13 at for example the peripheral edges. In such case, lamination across the entire contiguous surfaces of the exterior ply 11 and the interposed ply 13 may not occur.

Incorporated with the components of the breast cup assembly 1 is at least one under breast support strip 4. The under breast support strip 4 is captured or interposed between two plies of the breast cup assembly 1 at a desired location or desired locations. The desired locations include at least one of two preferred locations. A first preferred location is inwardly on the breast cup side and along a substantial part of the lower peripheral edge 16 of each breast cup 8, 9. This is for example shown in FIG. 2 where the under breast support strip 4 is positioned adjacent the peripheral edge 16. The lower peripheral edge of each breast cup is the boundary between the breast cup 9 and the peripheral flange 2.

Figure 2:
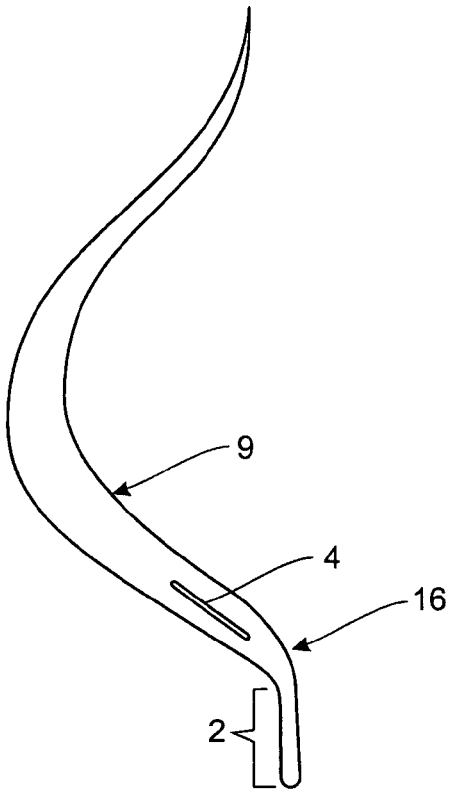
FIG. 2 is a sectional view through section AA illustrating the under breast support structure but wherein no distinction is made of the plies of material defining the breast cup assembly.
Figure 3A:
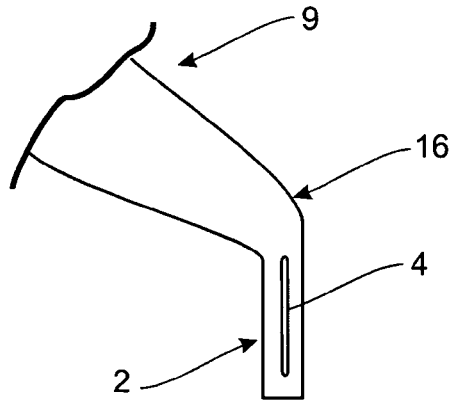
FIG. 3*a* is a sectional view through a variation to section AA showing the under breast support strip.

FIG. 3*a* illustrates an alternative location of the under breast support strip 4, where one is located on the other side of the lower peripheral edge 16 and situated between two plies of the assembly of plies within the flange 2. A further variation is where two independent under breast support strips 4*a* and 4*b* are provided one on each side of the lower peripheral edge 16. In yet a further variation as shown in FIG. 3*c*, the under breast support strip 4*c* extends across the lower peripheral edge 16 and is provided at both of the locations at which support is offered by the alternatives shown in FIGS. 2 and 3*a*.

Figure 4:
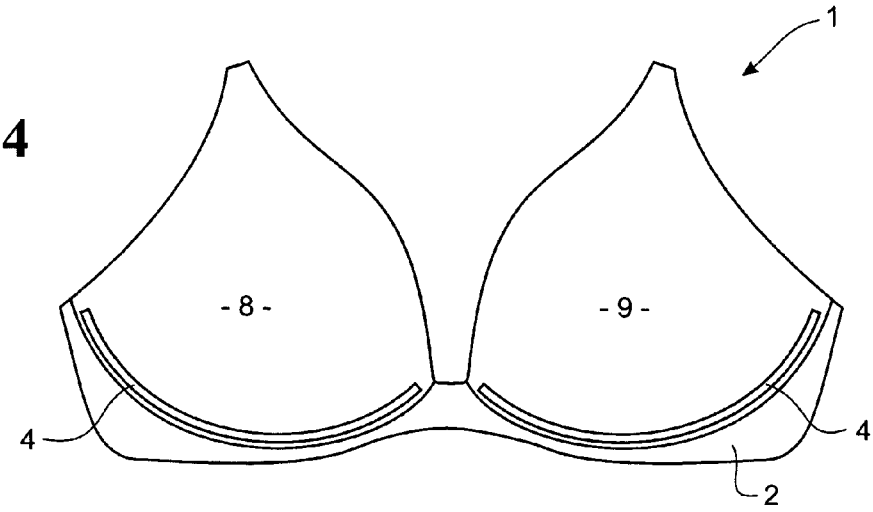
FIG. 4 is a front transparent view of a breast cup assembly for a bra illustrating positioning of the under breast support strip.

FIG. 4 illustrates a front view of the breast cup assembly 1 where an under breast support strip 4 is provided for each of the breast cups 8 and 9 in locations as described with reference to FIG. 2.

Figure 5:
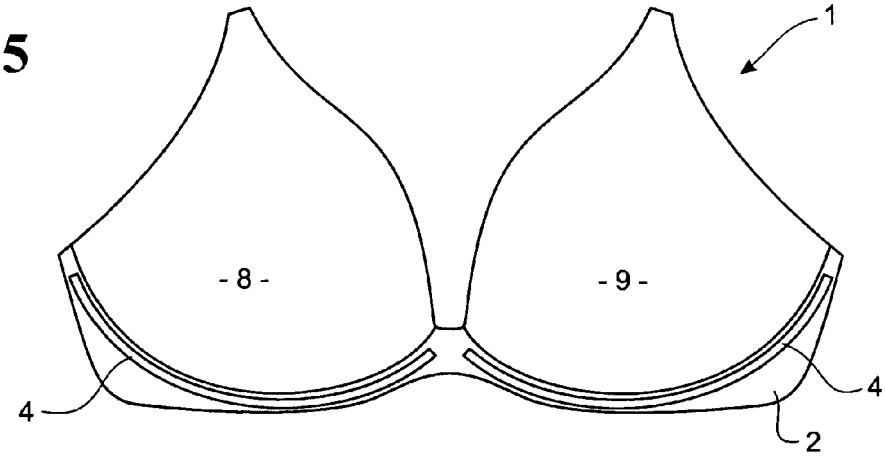
FIG. 5 shows a variation to the breast cup assembly of FIG. 4.

In FIG. 5 the variation as shown in FIG. 3*a* is illustrated.

Figure 3B:
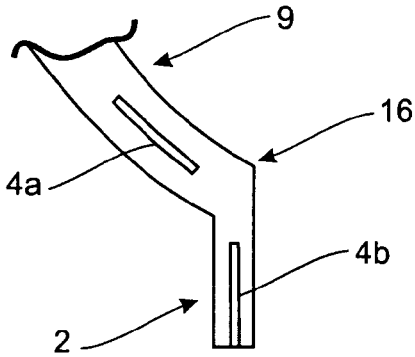
FIG. 3*b* is a variation through section AA showing the under breast support strip.
Figure 3C:
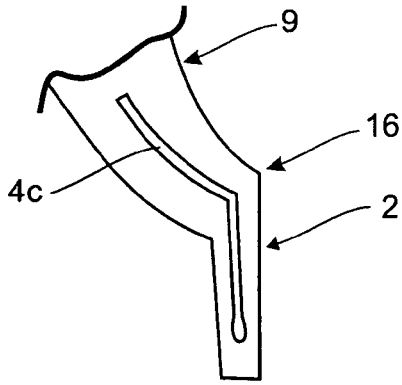
FIG. 3*c* shows a variation to section AA showing an alternative under breast support strip.
Figure 6:
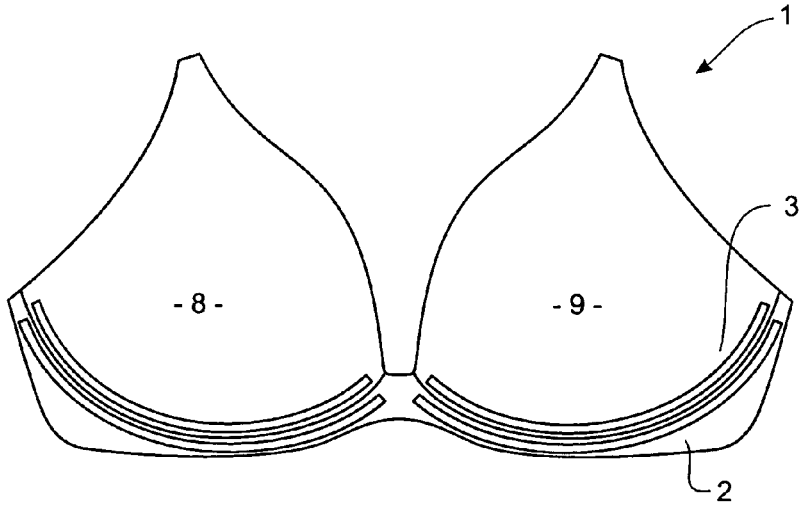
FIG. 6 shows a variation to the breast cup assembly of FIG. 4.

In FIG. 6 the variation as shown in FIG. 3*b* is illustrated. The under breast support strip 4 is incorporated between plies by heat bonding during the lamination and/or molding steps of at least two and preferably all of the plies of the assembly. The major surfaces of the under breast support strip 4 are parallel with the plies of material. Adhesive may also be applied to the under breast support strip 4 before the lamination to facilitate lamination.

Figure 8:
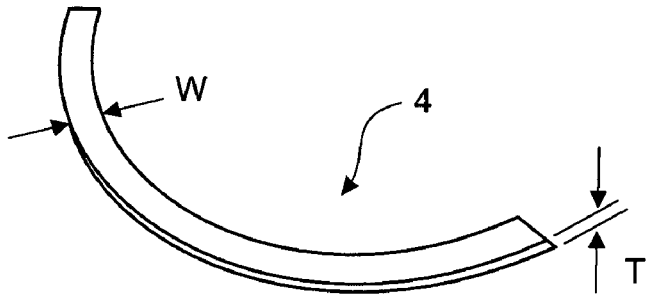
FIG. 8 is a perspective view of an under breast support strip.

The under breast support strip 4 as for example shown in FIG. 8 may be a non-woven fabric that is resiliently bendable yet substantially non-stretchable. It is preferably a planar or a thin walled member such as a strip that may consist of one ply or more plies of overlying material. It may comprise of several overlying plies of material which may be joined at the major surfaces thereof or at some or all of the edges thereof. A flattened non-woven fabric sock or channel may be used as the under breast support strip 4. The under breast support strip 4 may alternatively be a foam material. Where it is a foam material, it is preferably less elastic than any foam ply that may be used as the component to define any or all of the breast cup assembly 1. Since the material used for the under breast support strip 4 is to be subjected to a hot molding process to incorporate it into the breast cup assembly 1, such material must be able to withstand the temperature during the hot molding process. For example, it should not melt or, for instance, lose its non-stretchable characteristics. The hot molding process preferably involves, for example, a temperature of about 170° C. to 190° C. and a dwell time of about 120 seconds. The under breast support strip 4 is preferably of a flat and planar configuration having two major surfaces and of a constant thickness T that is substantially less than its width W. This means that its strength in bending in a direction parallel to the planes of the major surfaces is significantly greater than in a direction perpendicular to the major surfaces. The under breast support strip 4 is preferably not of a metallic material. It is preferably substantially non-stretchable yet is resiliently flexible in a direction normal to the major surfaces.

Prior to being incorporated into the breast cup assembly the under breast support strip 4 is preferably planar in configuration. The width "W" of the under breast support strip 4, in particular at its distal ends, helps prevent puncture of the plies of material defining the bra since the distal ends are not sharp when compared to the conventional underwire.

Figure 9:
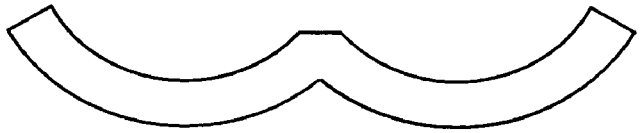
FIG. 9 is a plan view of a variation to the under breast support strip.

In a preferred form the under breast support strip 4 is positioned adjacent the lower periphery of one of the breast cups. However in an alternative form an under breast support member may be of a continuous form as shown in FIG. 9 to extend beneath the peripheries 16 of both breast cups 8 and 9 where a flange 2 and a bridge 6 are also present. In this form the under breast support strip 4 may be generally described as of "W" shape.

With reference to FIG. 2, in which, for convenience, there is no distinction made of the plies of material defining the breast cup assembly 1, the under breast support strip 4 is preferably interposed and completely captured within the plies of material defining the breast cup assembly. Where there are two or more plies of foam material defining the breast cup assembly, the under breast support member is preferably interposed between two plies of foam. Where a single ply of foam is interposed between two layers of fabric material, then the under breast support member 4 is preferably captured between the inner more ply of fabric material and the foam ply. Alternatively the breast support strip 4 is positioned between the external ply 11 of fabric material and the ply 13 of foam material. Where two under breast support strips are used as for example described with reference to FIG. 6, one or more of the under breast support strips may be located between different plies of material defining the breast cup assembly 1.

The advantage that the under breast support strip and its manner of incorporation with the components of the bra of the present invention provides is that it offers both the support function and the comfort of softness without the possibility of an underwire protruding from the bra.

A second preferred embodiment of the invention will now be described with reference to the accompanying drawings.

Figure 10A:
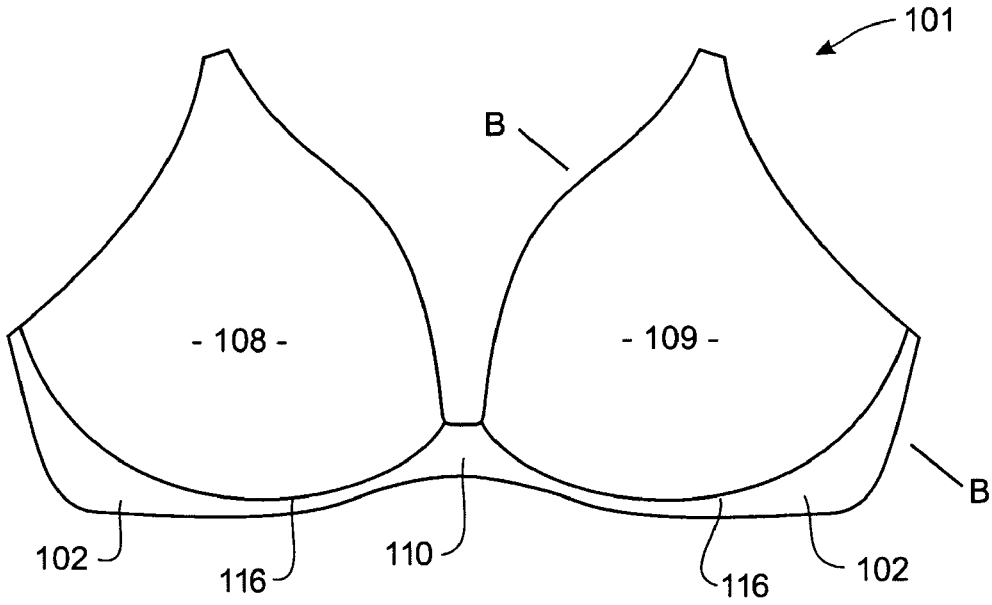
FIG. 10*a* is a front view of components defining the breast cup assembly for a bra of a second preferred embodiment.
Figure 17:
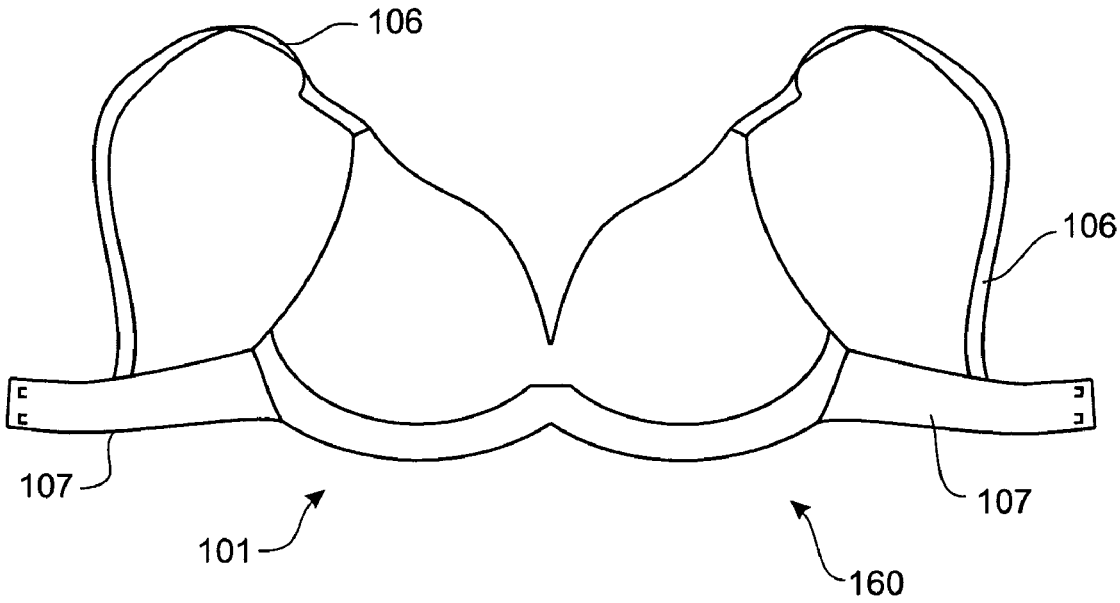
FIG. 17 illustrates a front view of a bra that includes the components of the breast cup assembly as shown with reference to FIGS. 10-16.

FIG. 10*a* is a front view of the breast cup assembly 101 which may form part of a bra 160 as shown in FIG. 17. The components of the breast cup assembly 101 as for example shown in FIG. 10*a* may comprise two plies of fabric material and may be incorporated with other components to define a bra 160 as for example shown in FIG. 17. The other components may include shoulder straps 106 and chest bands 107.

The chest bands 107 and the shoulder straps 106 may be separate components which are attached to the breast cup assembly 101, or they or any of them may be an extension of the breast cup assembly 101, i.e., the or part of the components defining the breast cup may extend beyond the boundary of the breast cup assembly 101 to define or constitute the chest bands 107 and/or the shoulder straps 106, in which case from the breast cup to the chest band there is no physical or externally visible boundary of the breast cup assembly 101 as such.

At least the components defining the breast cup assembly 101 of the bra of the second preferred embodiment are made by a molding and laminating process (preferably with use of adhesives) to define these components in their appropriate shape. Such components may define two breast cups 108 and 109 that are of a three dimensional and breast cup shape. The components of the breast cup assembly 101 are preferably of a seamless assembly of plies. The bra according to the second preferred embodiment is preferably a seamless bra. By seamless is understood to mean that the bra is visibly substantially seamless, in that the edges of the bra are finished in a seamless way. This may for example be achieved by ultrasonic welding, or by folding the edge of an outer layer over and affixing it to an inner layer by a non-stitching means, or by some other means that is substantially without seams. Shoulder straps 106 may be attached by stitching. Likewise, stitching may be applied to the region where a hook or eye tape is connected to the chest bands 107. In addition, seams may also be externally visible on the inner side of the bra.

The components defining the breast cup assembly 101 define breast cups 108 and 109, a bridge 110 between the breast cups 108 and 109 and a lower peripheral flange 102 which extends about at least part of the lower peripheral edge 116 of each of the breast cups 108 and 109. The lower peripheral flange 102 and the bridge 110 are preferably of identical configuration and are preferably formed by a ply or plies of a moldable material that are integral over the extent of the flange 102 and the bridge 110. This ply or these plies may be joined to components defining the breast cups 108 and 109 or may be integral with the moldable ply or plies defining the breast cups 108 and 109. Preferably the ply or plies of moldable material of the breast cup assembly 101 are continuous across the breast cups 108, 109 and the bridge 110 and the flange 102. The breast cup assembly 101 is preferably defined by two coextensive plies of moldable fabric material that are laminated together without any interposing plies of foam material.

The present invention may also be applicable where the bra does not include a flange 102.

Figure 10B:
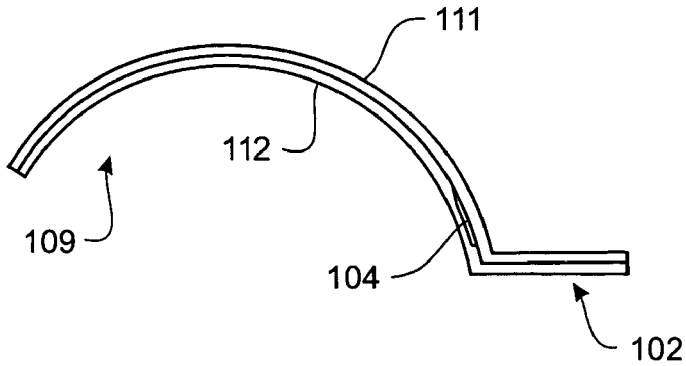
FIG. 10*b* is a sectional view through section BB of FIG. 10*a* of the second preferred embodiment.

With reference to FIG. 10*b*, the coextensive and contiguous plies of material defining the breast cup assembly 101 may consist of an exterior ply 111 of for example a fabric material and an interior ply 112 of for example a fabric material. These are preferably laminated or substantially laminated together across their entire contiguous surfaces, preferably with use of adhesives. The exterior ply 111 is preferably of a fabric material such as a synthetic woven material which may include polyester or may be of a kind commonly known as spandex. Likewise the interior ply 112 may also be of such a material.

Incorporated with the components of the breast cup assembly 101 is at least one under breast support strip 104. The under breast support strip 104 is captured or interposed between the two plies of material of the breast cup assembly 101 at a desired location or desired locations. The desired locations may include at least one of two preferred regions. A first preferred region is inwardly on the breast cup side and along a substantial part of the lower peripheral edge 116 of each breast cup 108, 109. This is for example shown in FIGS. 14 and 10*b* where the under breast support strip 104 is positioned adjacent the peripheral edge 116. The lower peripheral edge of each breast cup is the boundary between the breast cup 108, 109 and the peripheral flange 102.

Figure 11:
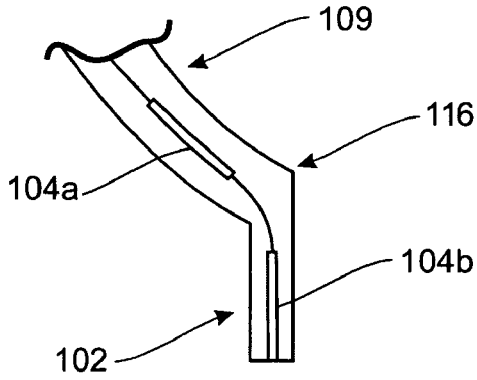
FIG. 11 is a sectional view through a variation to section BB showing the under breast support strip.
Figure 12:
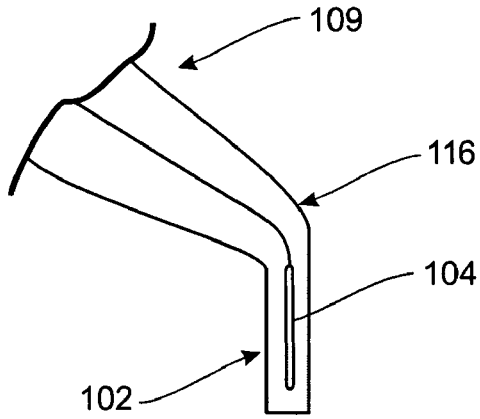
FIG. 12 is a variation through section BB showing the under breast support strip.
Figure 13:
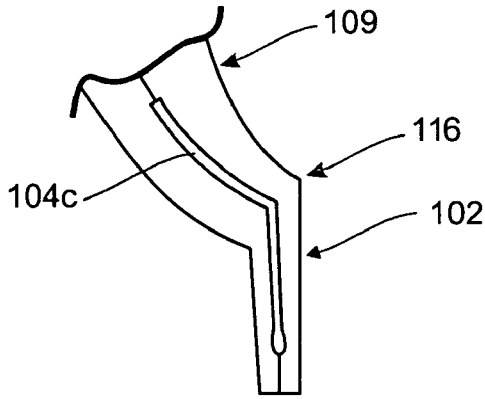
FIG. 13 shows a variation to section BB showing an alternative under breast support strip.

FIG. 12 illustrates an alternative location of the under breast support strip 104, where one is located on the other side of the lower peripheral edge 116. A further variation is shown in FIG. 11 where two independent under breast support strips 104*a* and 104*b* are provided one on each side of the lower peripheral edge 116. In yet a further variation as shown in FIG. 13, the under breast support strip 104*c* extends across the lower peripheral edge 116.

Figure 14:
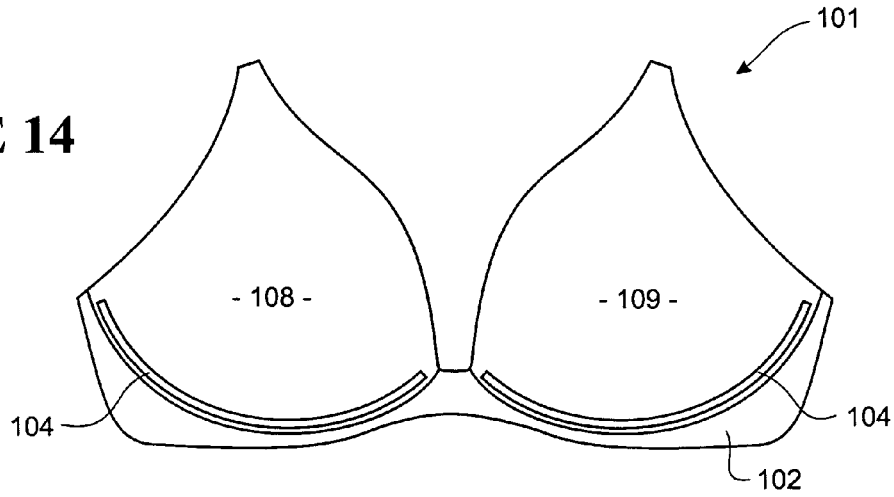
FIG. 14 is a front transparent view of a breast cup assembly for a bra of the second preferred embodiment illustrating positioning of the under breast support strip.

FIG. 14 illustrates a front view of the breast cup assembly 101 where an under breast support strip 104 is provided for each of the breast cups 108 and 109 in locations as described with reference to FIG. 10*b*.

Figure 15:
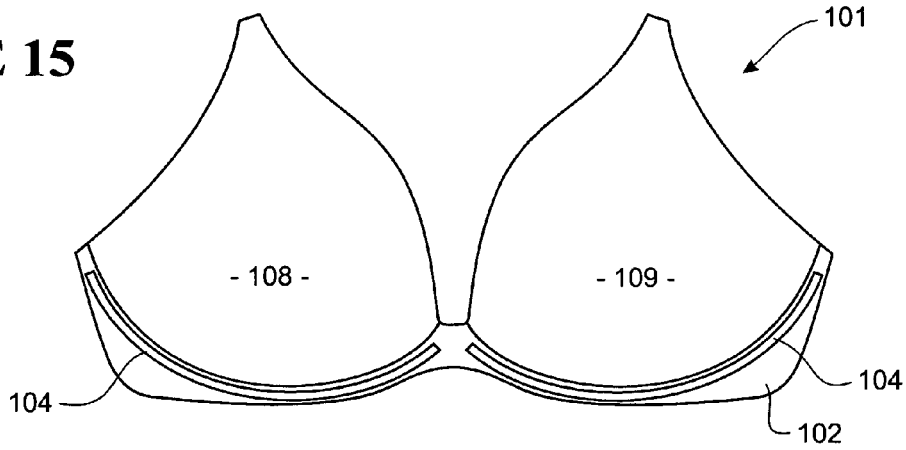
FIG. 15 shows a variation to the breast cup assembly of FIG. 14.

In FIG. 15 the variation as shown in FIG. 12 is illustrated.

Figure 16:
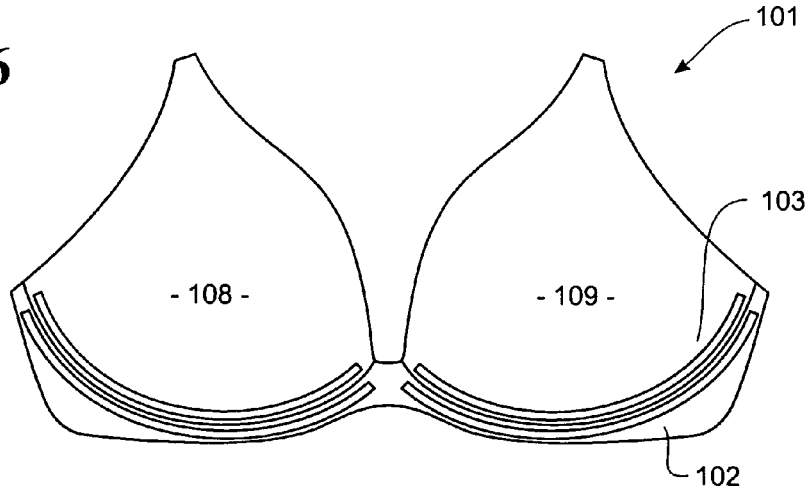
FIG. 16 shows a variation to the breast cup assembly of FIG. 14.

In FIG. 16 the variation as shown in FIG. 11 is illustrated.

The under breast support strip 104 is incorporated between plies 111, 112 by heat bonding during the lamination of the plies 111, 112. This may occur simultaneous with or prior to the molding of the plies of material between which the under breast support strip is placed to form the three-dimensional cup shape. The major surfaces of the under breast support strip are parallel with the plies of material 111, 112. Adhesives may also be applied to the under breast support strip 104 before the lamination to facilitate lamination.

Figure 18:
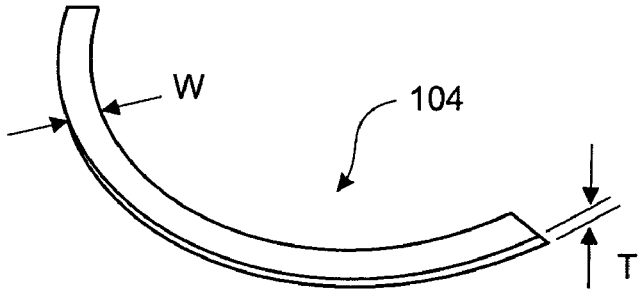
FIG. 18 is a perspective view of an under breast support strip for the second preferred embodiment.
Figure 19:
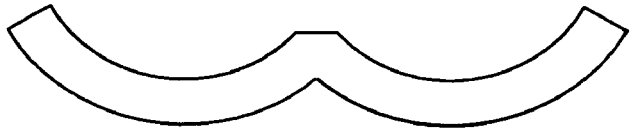
FIG. 19 is a plan view of a variation to the under breast support strip for the second preferred embodiment.

The under breast support strip 104 as for example shown in FIG. 18 may be a non-woven fabric that is resiliently bendable yet substantially non-stretchable. It is preferably a planar or a thin walled member such as a strip that may consist of one ply or more plies of overlying material. It may comprise several overlying plies of material which may be joined at the major surfaces thereof or at some or all of the edges thereof. A flattened non-woven fabric sock or channel may be used as the under breast support strip 104. The under breast support strip 104 may alternatively be a foam material. Where it is a foam material, it is preferably less elastic than any foam ply that may be used as the component to define any or all of the breast cup assembly 101. Since the material used for the under breast support strip 104 is to be subjected to a hot molding process to incorporate it into the breast cup assembly 101, such material must be able to withstand the temperature during the hot molding process. For example, it should not melt or, for instance, lose its non-stretchable characteristics. The hot molding process preferably involves, for example, a temperature of about 170° C. to 190° C. and a dwell time of about 120 seconds. The under breast support strip 104 is preferably of a flat and planar configuration having two major surfaces and of a constant thickness T that is substantially less than its width W. This means that its strength in bending in a direction parallel to the planes of the major surfaces is significantly greater than in a direction perpendicular to the major surfaces. The under breast support strip 104 is preferably not of a metallic material. It is preferably substantially non-stretchable yet is resiliently flexible in a direction normal to the major surfaces.

Prior to being incorporated into the breast cup assembly 101 the under breast support strip 104 is preferably planar in configuration. The width "W" of the under breast support strip 104, in particular at its distal ends, helps prevent puncture of the plies of material defining the bra since the distal ends are not sharp when compared to the conventional underwire.

In a preferred form the under breast support strip 104 is positioned adjacent the lower periphery of one of the breast cups. However in an alternative form an under breast support strip 104 may be of a continuous form as shown in FIG. 9 to extend beneath the peripheries 116 of both breast cups 108 and 109. In this form the under breast support member 104 may be generally described as of "W" shape.

The advantage that the under breast support strip 104 and its manner of incorporation with the components of the bra of the present invention provides is that it offers both the underwire support function and the comfort of softness without the possibility of an underwire protruding from the bra.

Figure 20:
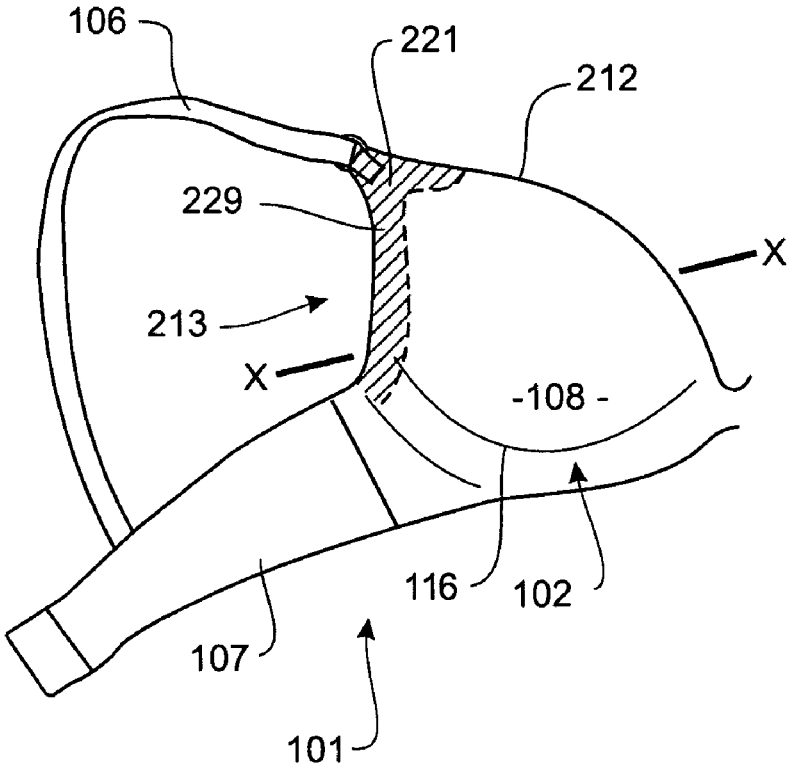
FIG. 20 is a front view of one half of a bra of the second preferred embodiment shown in a partial transparent manner to show a region of reinforcing.

With reference to FIG. 20, the breast cup assembly 101 may also include a peripheral flange 102 which extends at least about the lower periphery 116 of each of the breast cups 108 (and 119 which is not shown in FIG. 20) and about at least some of the side periphery 213 (also known as the underarm region of a bra as it extends between the chest bands that pass under the arm and the point where the shoulder strap is or can be attached) of each breast cup. A shoulder strap 106 may be provided. On the other side of the shoulder strap 106 is a neckline periphery 212.

The bra shown in part in FIG. 20 incorporates a substantially non-stretchable zone 221.

For each breast cup, the zone 221 exists at the top of and preferably runs at least along part of the side periphery 213. Here, the sideway force pushing the breast cup away from the body is large compared to other forces on the bra at some other regions. The zone 221 preferably also extends from the point or the region or area adjacent the point where the shoulder strap 106 is attached to the breast cup. This region also requires reinforcement because the tensile force pulling the bra cup in a direction along the direction of the shoulder strap away from the cup is high.

Such a zone 221 is preferably defined by a reinforcing member 229 which is an adhesive film.

Figure 20A:
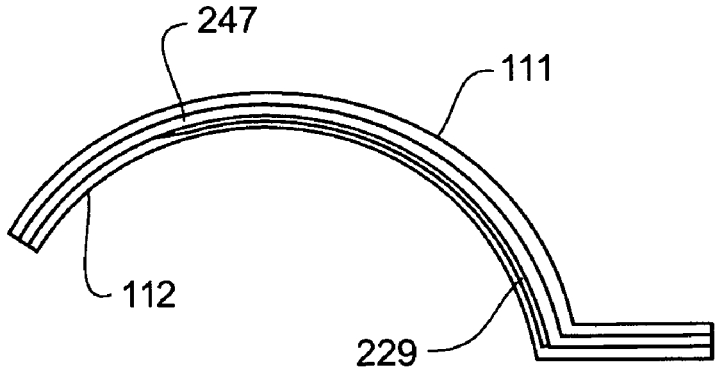
FIG. 20*a* is a sectional view through section XX of FIG. 20.

The reinforcing member 229 is interposed between the two fabric plies 112 and 111 as shown in FIG. 20*a*. The fabric plies are laminated or substantially laminated to each other and molded to the cup shape. Because two fabric plies alone may not provide sufficient support to counter the tensile force of, for example, the left cup moving from the centre to the left when the bra is in use, the reinforcing member 229 is provided.

In a preferred form the reinforcing member 229 is a hot-melt adhesive film such as Bemis 3410. This is a thermoplastic adhesive film sometimes also known as a hot-melt film or thermo sensitive film. The reinforcing member 229 is preferably transparent and not externally visible through the relatively thin fabric layer.

Where the breast cups 108 and 109 and preferably the rest of the bra 101 are made up predominantly only of an outer fabric ply 111 laminated with an inner fabric ply 112, the fabric plies are preferably a polyester or spandex or similar synthetic woven material. A film of say 0.001 inch of a hot-melt adhesive film 247 (e.g. Bemis 3410) is applied between the outer and inner plies 111, 112 prior to and for purpose of laminating the two plies. Spray adhesive or hot-melt adhesive chips can alternatively be used instead of hot-melt adhesive film to laminate the outer ply 111 with the inner ply 112. Lamination is preferably achieved under hot pressing conditions.

The zone 221 has an additional hot-melt adhesive film of for example 0.001 inch Bemis 3410 applied between the inner and outer plies to act as the reinforcing member 229. This hot-melt adhesive film is applied in addition to the hot-melt adhesive film or spray adhesive or hot-melt adhesive chips used for laminating the outer and inner fabric plies 111 and 112 together.

Thus, if 0.001 inch of hot-melt adhesive film 247 is used for laminating the outer and inner plies 111 and 112 together, at the zone 221 before hot pressing the total thickness of the hot-melt adhesive film will be 0.002 inch because of the additional hot-melt adhesive layer acting as the reinforcing member 229. Upon hot pressing and subsequent cooling, the outer and inner plies 111 and 112 are laminated to each other, and at the zone there will be the additional support provided by the reinforcing member 229 being the hot-melt adhesive film. In effect there is a higher density of hot-melt adhesive at the zone. The additional support provided in this way is not externally visible or conspicuous through the thin fabric plies 111 and 112. After hot pressing, the hot-melt adhesive film would not necessarily still be "intact" as a film because it will have melded with the adjacent plies of material, but its effect of providing additional support will be there after the hot pressing and molding step(s). In FIG. 20*a* the films 229 and 247 of the hot melt adhesive are shown for convenient explanation as if they are plies. The hot-melt adhesive may be said to be embedded between or by the plies.

The 3-D cup shape of the breast cup may be formed by molding at the same time as or as a separate and subsequent step to the hot pressing step. Shoulder straps and/or fasteners (such as hooks and eyes) may subsequently be attached to form the finished bra.

Figure 21:
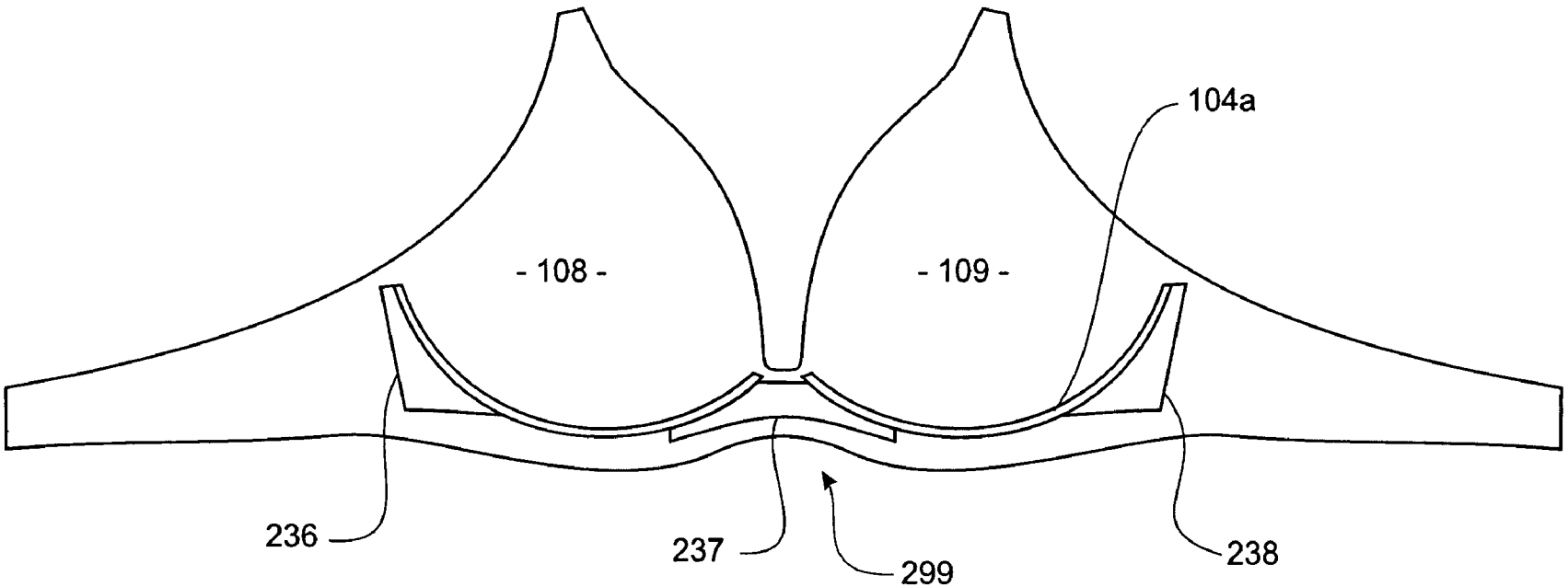
FIG. 21 is a front view of a bra of the second preferred embodiment wherein additional support may be provided in addition to the reinforcing provided and described with reference to FIGS. 20 and 20*a*, shown in a partial transparent manner to show the additional support.

Additional reinforcing may also exist at the bridge region 299 between the two breast cups 108 and 109 as shown in FIG. 21 and preferably at the peripheral flange 102 below the breast cups and optionally at the sides of the breast cups. FIG. 21 shows such additional reinforcing wherein a panel or panels of material such as panels 236, 237 and 238 are located about the periphery 116 of each breast cup 108 and 109. A panel 237 extends across the bridge region 299. The panels 236, 237 and 238 may alternatively be defined by a single panel that covers the same extent as panels 236, 237 and 238. A single panel may be used where, for example, the margin under the breast cup allows. The additional reinforcing is located intermediate of the plies 111 and 112 by the use of adhesive film which may be activated for lamination with the panels 236, 237 and 238 with or without heat, such as by hot molding. For example, the panels 236, 237 and 238 may, during the manufacture of the bra, be adhered to one of the plies 111 or 112 of the breast cup assembly before it is engaged to the other ply 111 or 112 of the breast cup assembly. Once the other ply of the breast cup assembly is applied, the assembly can be pressed together by for example hot molding for the purposes of forming and lamination and then trimmed. The panels 236, 237 and 238 may be made of one or more plies of material. They are preferably of a substantially non-stretchable material such as non-woven fabric. The function of the panels 236, 237, 238 is to help resist the stretchable nature of the plies 111 and 112, which need to be stretchable in appropriate regions to allow their bulging to occur. At the bridge region 299, the panel 237 aids in resisting separation of the breast cups 108, 109 away from each other. At the side regions adjacent to the intersection of the chest band 107 and the breast cup 108, 109, the panels 236 and 238 resist the sideways pulling from the chest bands which may otherwise lead to the breast cup periphery at this region being pulled too far under the arms or to pulling the breast cup flatter against the chest. Such stretching also needs to be resisted at the lower and lower side regions of each breast cup in order to prevent the bra from riding up over the breast or to prevent the breast from "falling out" of the bra. The non-stretchable material can be positioned to offer additional tensile strength in the desired directions to the bra. In particular, an example of the desired direction is a direction to offer hoop-strength to the bra about the torso of the wearer, in other words the strength to resist a stretching of the lower part of the bra that includes the chest bands and the lower breast cup assembly.

While the present invention has been described with reference to particular embodiments thereof, it will be understood that such embodiments are susceptible of modifications and variations without departing from the scope of the present invention and that the invention will include all embodiments falling within the scope of the appended claims.

The invention claimed is:

1. A brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) a non-metallic resiliently bendable under breast support strip laminated with and interposed between two of the at least two plies of material at or adjacent the lower peripheral edge of one or both of the two breast cups, wherein two of the plies of material are fabric plies and an intermediate ply is interposed between the two fabric plies, and wherein the under breast support strip is laminated to and between one of the two fabric plies and the intermediate ply.

2. A brassiere cup assembly as claimed in claim 1 wherein the under breast support strip is located on the breast cup side adjacent the lower peripheral edge.

3. A brassiere cup assembly as claimed in claim 2 wherein two of the under breast support strip are provided, each of which being located on the breast cup side adjacent the lower peripheral edge of one of the two breast cups.

4. A brassiere cup assembly as claimed in claim 3 wherein a further two of the under breast support strip are provided, each of which being located on the flange side adjacent the lower peripheral edge of one of the two breast cups.

5. A brassiere cup assembly as claimed in claim 3 wherein a further under breast support strip is provided, the further under breast support strip being a unitary under breast support strip that extends adjacent the lower peripheral edge of both breast cups on the flange side and across the bridge.

6. A brassiere cup assembly as claimed in claim 1 wherein the under breast support strip is located on the flange side adjacent the lower peripheral edge.

7. A brassiere cup assembly as claimed in claim 6 wherein two of the under breast support strip are provided, each of which being located on the flange side adjacent the lower peripheral edge of one of the two breast cups.

8. A brassiere cup assembly as claimed in claim 6 wherein the under breast support strip is a unitary under breast support strip that extends adjacent the lower peripheral edge of both breast cups and across the bridge.

9. A brassiere cup assembly as claimed in claim 1 wherein at least two of the at least two plies of material are co-extensive with each other.

10. A brassiere cup assembly as claimed in claim 1 wherein only two plies of material are provided, each being a fabric ply.

11. A brassiere cup assembly as claimed in claim 1 wherein the intermediate ply comprises at least one layer of foam.

12. A brassiere cup assembly as claimed in claim 1 wherein the intermediate ply is coextensive with the two fabric plies.

13. A brassiere cup assembly as claimed in claim 1 wherein at least at the breast cups, a core assembly of at least two laminated plies of foam material is provided, and wherein the under breast support strip is laminated to and between the two laminated plies of foam material.

14. A brassiere cup assembly as claimed in claim 1 wherein the under breast support strip is of a width greater than its thickness.

15. A brassiere cup assembly as claimed in claim 1 wherein the under breast support strip includes a non-woven material.

16. A brassiere cup assembly as claimed in claim 1 wherein the under breast support strip includes a non-woven fabric.

17. A brassiere cup assembly as claimed in claim 1 wherein the under breast support strip includes a substantially non-stretchable material.

18. A brassiere cup assembly as claimed in claim 1 wherein the under breast support strip includes a foam material.

19. A brassiere cup assembly as claimed in claim 11 wherein the under breast support strip includes a foam material that is harder than the foam of the intermediate ply.

20. A brassiere cup assembly as claimed in claim 13 wherein the under breast support strip includes a foam material that is harder than the foam of the core assembly.

21. A brassiere cup assembly as claimed in claim 1 wherein the brassiere cup assembly is made by a hot molding process, during which process the under breast support strip is incorporated into the brassiere cup assembly.

22. A brassiere that includes a brassiere cup assembly as claimed in claim 1.

23. A brassiere as claimed in claim 22 that is a seamless brassiere.

24. A brassiere as claimed in claim 22 that is a seamless and molded brassiere.

25. A brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) two non-metallic resiliently bendable under breast support strips respectively laminated with and interposed between two of the at least two plies of material on the breast cup side adjacent the lower peripheral edge of the two breast cups, wherein a further two of the under breast support strip are provided, each of which being located on the flange side adjacent the lower peripheral edge of one of the two breast cups.

26. A brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) two non-metallic resiliently bendable under breast support strips respectively laminated with and interposed between two of the at least two plies of material on the breast cup side adjacent the lower peripheral edge of the two breast cups, wherein a further under breast support strip is provided, the further under breast support strip being a unitary under breast support strip that extends adjacent the lower peripheral edge of both breast cups on the flange side and across the bridge.

27. A brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) a non-metallic resiliently bendable under breast support strip laminated with and interposed between two of the at least two plies of material at or adjacent the lower peripheral edge of one or both of the two breast cups, wherein at least at the breast cups, a core assembly of at least two laminated plies of foam material is provided, and wherein the under breast support strip is laminated to and between the two laminated plies of foam material.

28. A brassiere cup assembly as claimed in claim 27 wherein the under breast support strip includes a foam material that is harder than the foam of the core assembly.

29. A brassiere cup assembly defining two breast cups, a bridge between the two breast cups, and for each of the two breast cups a flange extending from at least part of a lower peripheral edge of the breast cup, the brassiere cup assembly comprises:

(a) at least two plies of material which are laminated to each other and molded to define the shape of the two breast cups; and (b) a non-metallic resiliently bendable under breast support strip laminated with and interposed between two of the at least two plies of material at or adjacent the lower peripheral edge of one or both of the two breast cups, wherein the under breast support strip includes a foam material.

* * * * *

UNITED STATES PATENT AND TRADEMARK OFFICE

CERTIFICATE OF CORRECTION

PATENT NO. : 7,604,526 B2
APPLICATION NO. : 11/471841
DATED : October 20, 2009
INVENTOR(S) : Zhen Qiang Liu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 469 days.

Signed and Sealed this

Fifth Day of October, 2010

David J. Kappos

David J. Kappos
*Director of the United States Patent and Trademark Office*